US005775501A

United States Patent [19]

Wleklinski et al.

[11] Patent Number: 5,775,501

[45] Date of Patent: Jul. 7, 1998

[54] PACKAGING FOR PHOTOGRAPHIC PAPER

[75] Inventors: Helmut Wleklinski, Bergisch Gladbach; Georg Fryda, München, both of Germany; Rene Degroeve, Deurne, Belgium

[73] Assignee: AFGA-Gevaert Aktiengesellschaft, Germany

[21] Appl. No.: 788,506

[22] Filed: Jan. 24, 1997

[30] Foreign Application Priority Data

Jan. 25, 1996 [DE] Germany ..... 196 02 526.5

[51] Int. Cl.[6] ..... B65D 85/67

[52] U.S. Cl. ..... 206/416; 206/389

[58] Field of Search ..... 206/316.1, 389, 206/409, 416, 455

[56] References Cited

U.S. PATENT DOCUMENTS

| | | | |
|---|---|---|---|
| 2,797,804 | 7/1957 | Pomeroy et al. . | |
| 5,161,685 | 11/1992 | Harris et al. | 206/409 |
| 5,246,111 | 9/1993 | Shibazaki et al. | 206/409 |
| 5,447,829 | 9/1995 | Tamai et al. | 206/389 |

FOREIGN PATENT DOCUMENTS

| | | |
|---|---|---|
| 0506093 | 1/1990 | European Pat. Off. . |
| 0444611 | 9/1991 | European Pat. Off. . |
| 1 290 447 | 4/1961 | France . |
| 36 27 981 | 2/1987 | Germany . |

OTHER PUBLICATIONS

Research Disclosure, Bd. 229, Nr. 32, May 10, 1983, Havant GB, Seite 190 XP00209731 H. Cornelissen et al "Roll Package".

*Primary Examiner*—David T. Fidei
*Attorney, Agent, or Firm*—Connolly & Hutz

[57] ABSTRACT

Daylight loading packaging for photographic paper in the form of rolls comprising lateral, annular flanges and a casing lengthening piece welded to the flanges, which casing lengthening piece is connected at one end to the start of the paper roll and is free at the other end, the flanges presenting a concentric annular hole the edge of which is welded to the edge of the roll tube and which on one side of a paper base has at least one blackened layer forming a light barrier, at least one aluminium layer forming a vapour barrier, at least one layer which increases resistance to puncture, and furthest away from the paper base a layer which permits welding to the casing lengthening piece and the roll tube, and which has on the other side of the paper base a layer of a synthetic polymer applied by extrusion which imparts a tension to the material which prevents an inward collapse of the flange (seen from the roll).

3 Claims, 1 Drawing Sheet

PACKAGING FOR PHOTOGRAPHIC PAPER

BACKGROUND OF THE INVENTION

Photographic paper is frequently used in the form of large rolls the width of which corresponds to the width of the desired photo format, e.g. 7, 10, 13 cm etc. The rolls are packed so that they are light-tight. In order to be able to use them, they are usually placed in a cassette which is attached to the processing machine. In order to prevent any pre-exposure, including pre-exposure of the edges of the photograph, the paper roll must be placed in the cassette with the packaging material removed in the dark.

Placing the paper roll in the cassette in the dark is cumbersome, error-prone and frequently impossible, for example in so-called minilabs, as these processing machines are frequently installed in restricted areas where there are no rooms in the immediate vicinity that can be darkened.

In order to remedy this shortcoming day-light loading packaging (DLL from "day-light-loading") has been developed, whereby the roll is placed in the cassette together with the packaging material. This packaging is structured as follows:

The photographic paper is wound onto a round paper tube. A round, opaque flange, corresponding in size to the size of the roll and with a round opening in the centre corresponding to the tube, is attached to the right and left respectively and welded to the edge of the tube along its opening. An opaque casing lengthening piece is sealed to the end of the photographic paper, wound round the photographic paper and welded at its edges to the round edges of the flanges.

The assembly is placed in the cassette in such a way that the free end of the casing lengthening piece projects from the opening of the cassette.

After being placed in the cassette the casing lengthening piece is loosened at the weld seams from the flanges by pulling at the end of the casing lengthening piece which projects out of the cassette opening and pulled out of the cassette. The cassette can then be docked in the printing device and printing can commence.

The material for the flanges is made up of several layers:

On the outside, for example, a layer of paper about 130 μm thick is provided to form the base; there follow at least one blackened layer forming a light barrier, at least one aluminium layer forming a vapour barrier, at least one layer which increases resistance to puncture and furthest away from the paper base a layer which permits welding to the casing lengthening piece respectively the paper tube. The subsequent layers on the paper have a total thickness of 120 μm for example.

Even though this packaging meets all the requirements for easy handling, light-tightness and resistance to puncture, it has a serious disadvantage in that, in the case of some exposure machines (printers), once the photographic paper is largely unwound, the outer regions of the flanges collapse inward and are wound in with the photographic paper when it is re-wound. Apart from the possible damage, the winding diameter of the photographic paper rollers becomes larger as a result than the associated paper length. Defective residual lengths are then reported in printers with residual length definition.

SUMMARY OF THE INVENTION

The object of the invention was to avoid this disadvantage.

This object is achieved in that a layer 20 to 60 μm thick for example of synthetic polymer is applied by extrusion externally to the paper base of the flanges. This layer, which is preferably of polyethylene, imparts a tension to the material which prevents the inward collapse of the flange.

The plastic layer is preferably 30 to 50 μm thick and is made of HDPE (high density polyethylene).

In a preferred embodiment a heat-resistant paint is also applied to the polymer layer, in order to prevent the polymer layer from melting when the flange and casing lengthening piece are welded together.

BRIEF DESCRIPTION OF THE DRAWINGS

Novel features and advantages of the present invention in addition to those discussed above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
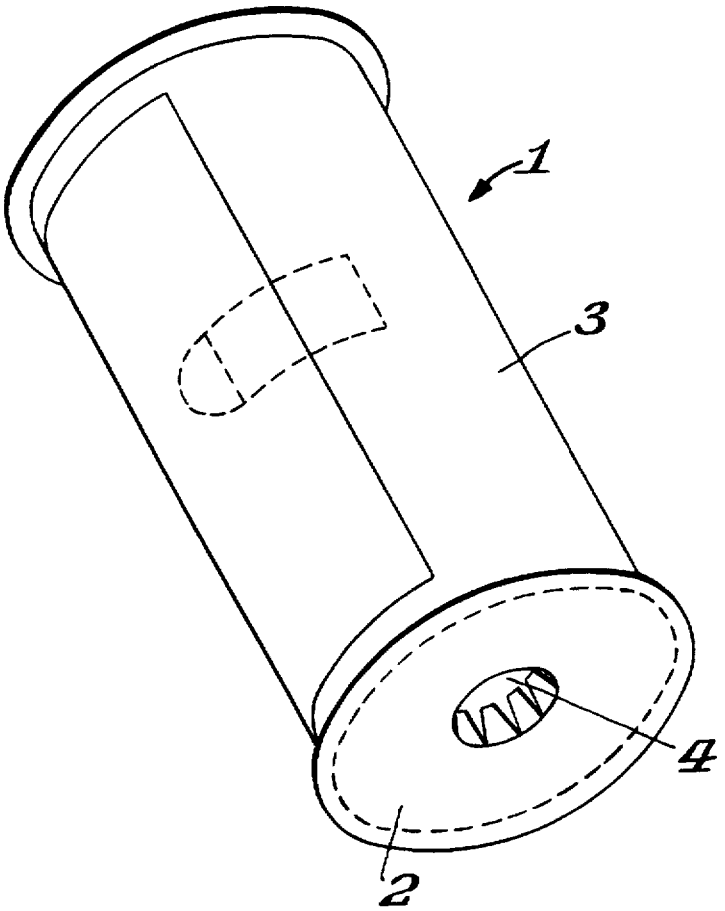
FIG. 1 is a perspective view of daylight loading packaging comprising photographic paper wound onto a paper tube, according to the present invention.

FIG. 1 illustrates photographic paper wound onto a paper tube 4 to thereby provide daylight loading packaging 1. The photographic paper is covered by a casing lengthening piece 3 commonly called "light-shielding leader". The opposite sides of tube 4 include flanges 2.

Figure 2:
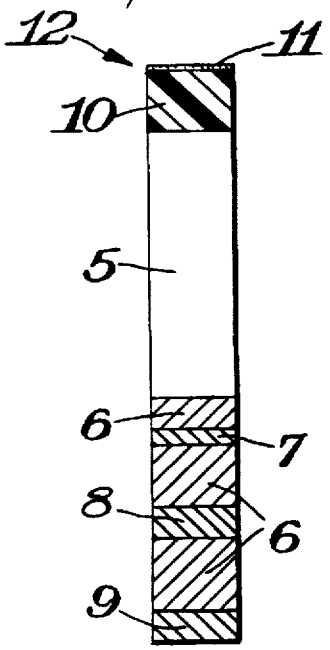
FIG. 2 is a cross-sectional view of one embodiment of the flange material positioned at the ends of the paper tube shown in FIG. 1.

FIG. 2 illustrates the cross-section of one embodiment of the flange material. Specifically, a paper support 5 is covered on one side by a blackened layer forming a light barrier 6, an aluminum layer forming a vapor barrier 7, a layer which increases resistance to puncture 8 and a layer 9 which permits welding or otherwise securing the flanges 2 to casing lengthening piece 3. In this particular embodiment there are two additional blackened layers 6. The other side of the paper support 5 includes a layer 10 of a synthetic polymer. The application of layer 10 imparts a tension to the flange material which pervents an inward collapse of the flange. Layer 10 may be covered by a heat-resistant paint 11 which represents the outside 12 of the flange material.

We claim:

1. Daylight loading packaging for photographic paper in the form of a roll of photographic paper wound around a tubular core, the packaging comprising spaced apart end flanges and a casing lengthening piece secured between the flanges, the lengthening piece having one end connected to a start end of a roll of photographic paper and an unattached free other end, a circular opening in each flange having edge portions for securement to end edges of the tubular core, and wherein each flange comprises a paper base with at least one inside blackened layer forming a light barrier, at least one inside aluminum layer forming a vapor barrier, at least one inside layer which increases resistance to puncture, and an innermost layer which permits securement to the casing lengthening piece and the tube roll, and wherein the flanges include an outside layer of a synthetic polymer for imparting tension to the flanges to thereby prevent inward collapse of the flanges.

2. Daylight loading packaging as in claim 1 wherein outside layer on each flange is polyethylene at a thickness of 20 to 60 μm.

3. Daylight loading packaging as in claim 1 including heat resistant paint applied to the polymer layer on each flange.

* * * * *